US006527605B1

(12) United States Patent
Charte

(10) Patent No.: US 6,527,605 B1
(45) Date of Patent: Mar. 4, 2003

(54) CHILD LOCATOR BUOY

(76) Inventor: Robert A. Charte, Rte. 2, Box 770, Appomattox, VA (US) 24522

( * ) Notice: Subject to any disclaimer, the term of this patent is extended or adjusted under 35 U.S.C. 154(b) by 0 days.

(21) Appl. No.: 09/933,763

(22) Filed: Aug. 22, 2001

(51) Int. Cl.[7] ..... B63B 22/18
(52) U.S. Cl. ..... 441/26; 441/7
(58) Field of Search ..... 441/23–26, 89, 441/5, 7

(56) References Cited

U.S. PATENT DOCUMENTS 1,588,798 A * 6/1926 Moore ..... 441/26
4,014,478 A * 3/1977 Bonacina ..... 242/379
4,527,504 A * 7/1985 Byerley ..... 116/209

* cited by examiner

*Primary Examiner*—Jesus D. Sotelo

(57) ABSTRACT

An automatically retractable buoy secured to the trunk of a child in a manner not interfering with play in and out of the water, the buoy providing no buoyancy for the child but having sufficient buoyancy to remain on the surface and thus serve as an aid in locating the child whenever the child is submerged.

6 Claims, 9 Drawing Sheets

CHILD LOCATOR BUOY

BACKGROUND OF THE INVENTION

The present invention relates to water safety devices and, more specifically, to a child locator buoy.

The affinity of children for water is well known and it has long been a problem for parents or other supervisors to know the exact location of their wards at play at swimming holes, on river banks and particularly on crowded seaside beaches. The risk is particularly for small children playing in the surf where they may be knocked from their feet by a wave and swept away, seaward or up or down the beach, by the ocean currents.

Brightly colored and distinctive clothing is an advantage, but clothing is not always visible to the supervisor as the clothing may be submerged in normal play and of no assistance whatsoever in the event the child is submerged.

Brightly colored floating toys offer some protection. However, it is difficult for a child to freely swim or play in or near the water while maintaining contact z- z with such toys, and they are often discarded. Moreover, such toys are of no assistance in the event a child is inadvertently separated from the toy and in distress.

Brightly colored personal floatation devices such as water wings or life jackets are also helpful but are generally bulky and a great annoyance to the child when playing in and out of the water or merely wading in the surf. In addition, such devices interfere with swimming and playing in deeper waters because of their buoyancy. Children often want to dive in the water and play games that require freedom of motion and unencumbered swimming, and personal floatation devices interfere with such normal play.

There are specialized devices that assist the location of an underwater swimmer or scuba diver. Such devices generally consist of a small float attached to the wrist or ankle of a diver where they can be selectively released in the event of an underwater emergency to float to the surface and thus mark the location of the diver. By way of example, the Gooding U.S. Pat. No. 4,664,638 discloses a selectively releasable float which may be appropriate for trained divers, but is not appropriate for small children. In addition to the requirement that they have to be released, inadvertent release may be a hazard because the tether does not retract and a child may become entangled in the tether.

Buoys with self-retracting lines are also known to mark objects fixed to the seabed, generally to mark underwater obstructions in areas with significant tides where a fixed length may permit significant lateral drift of the buoy as the water ebbs. Such retracting lines may also be used to more closely mark the location of a boat anchor, so that the anchor may be more readily freed from the bottom by positioning the boat over the anchor for vertical lifting. Such a line shortening mechanism is shown, for example, in the Gram U.S. Pat. No. 4,808,133. However, such line shortening mechanisms have heretofore not been thought to be useful in marking the location of submerged but drifting objects. Furthermore, the retraction mechanism and lines are far too robust, and thus bulky and weighty, for use with personnel, particularly small children.

Accordingly, it is an object of the present invention to obviate many of the disadvantages of known water safety device when employed in a beach environment and to provide a novel device for assisting the location of a child playing in or around water.

It is another object of the present invention to provide a child locator buoy which does not interfere with the normal play of the child in or out of the water, but which is a location aid in the event of distress.

It is still another object of the present invention to provide a child locator buoy which is always visible at the surface of the water, with the length of the tether automatically adjusting to the depth, if any, of the child below water to minimize the inconvenience to the child as he or she moves into and out of the water or engages in active play.

A further object of the present invention is to provide a novel buoy the position of which is automatically controlled by a balance between the forces of buoy flotation and the force of retraction.

These and many other objects and advantages of the present invention will be readily apparent to one skilled in the art to which the invention pertains from a perusal of the claims when read in conjunction with the appended drawings and the following detailed description of preferred embodiments.

THE DRAWINGS

Figure 1:
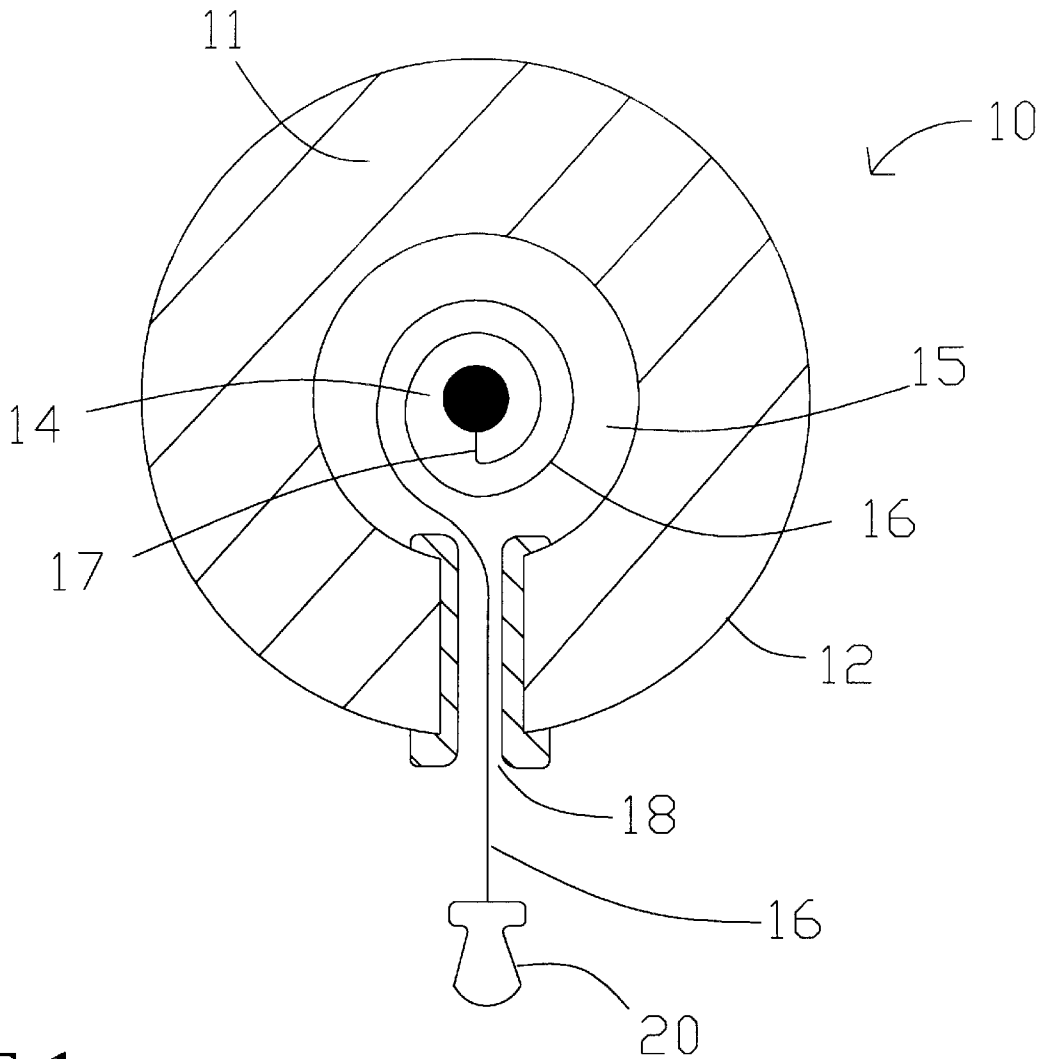
FIG. 1 is a pictorial representation of one embodiment of the buoy of the present invention ross section, schematically illustrating the internal tether biasing mechanism disposed centrally therein.
Figure 2:
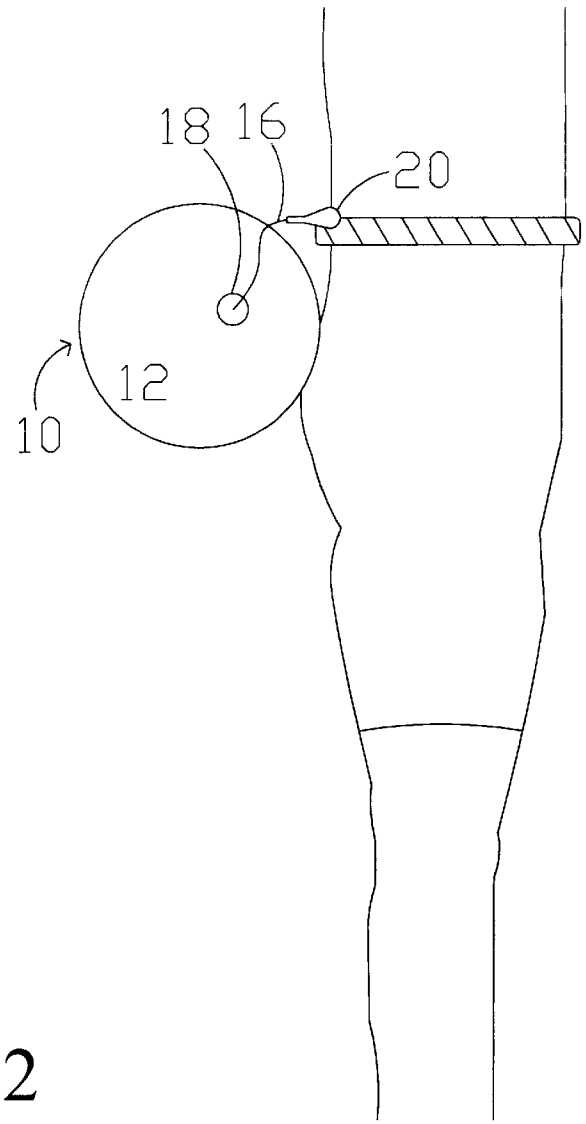
FIG. 2 is a pictorial representation of the embodiment of FIG. 1 illustrating one method of securing it adjacent the small of the child's back.
Figure 3A:
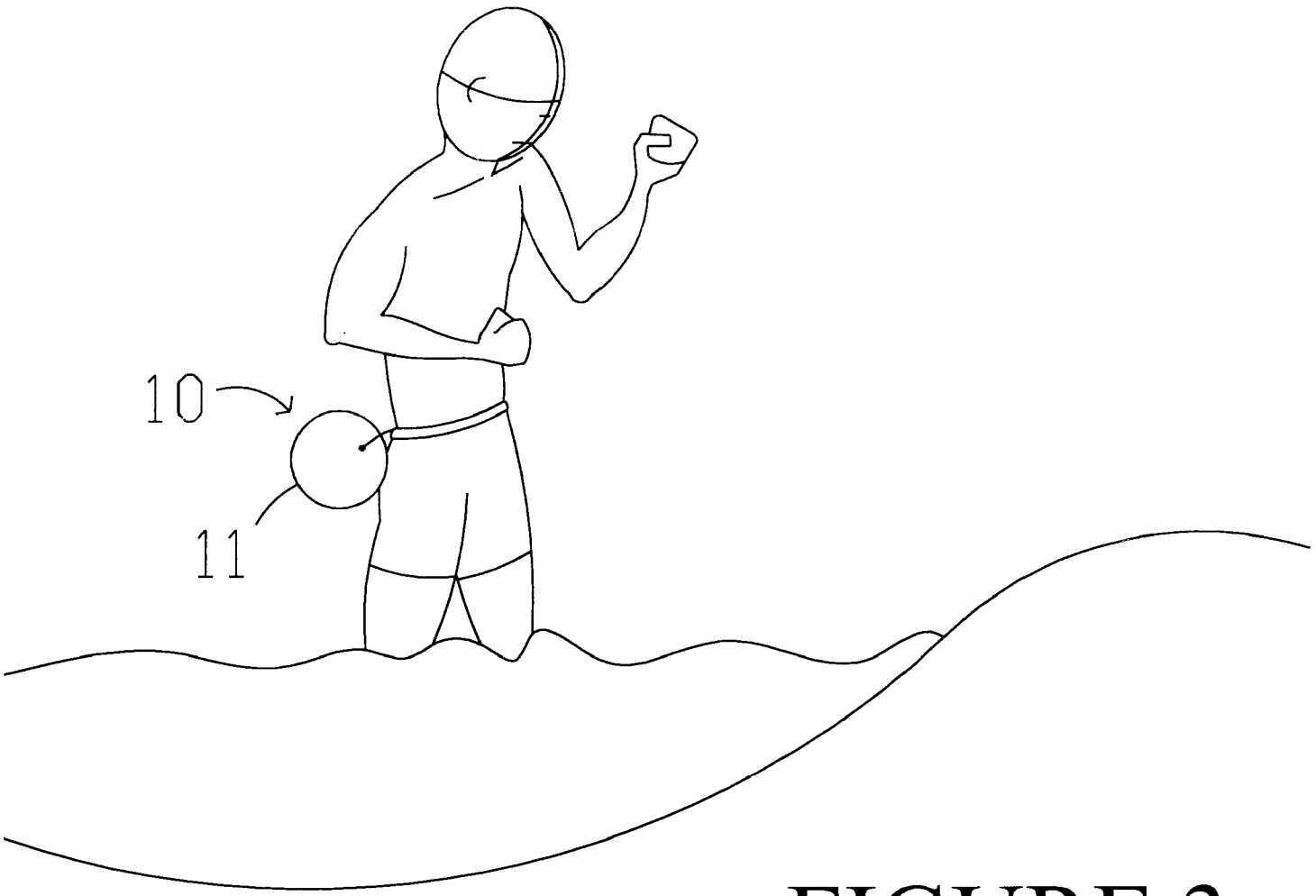
Figure 3B:
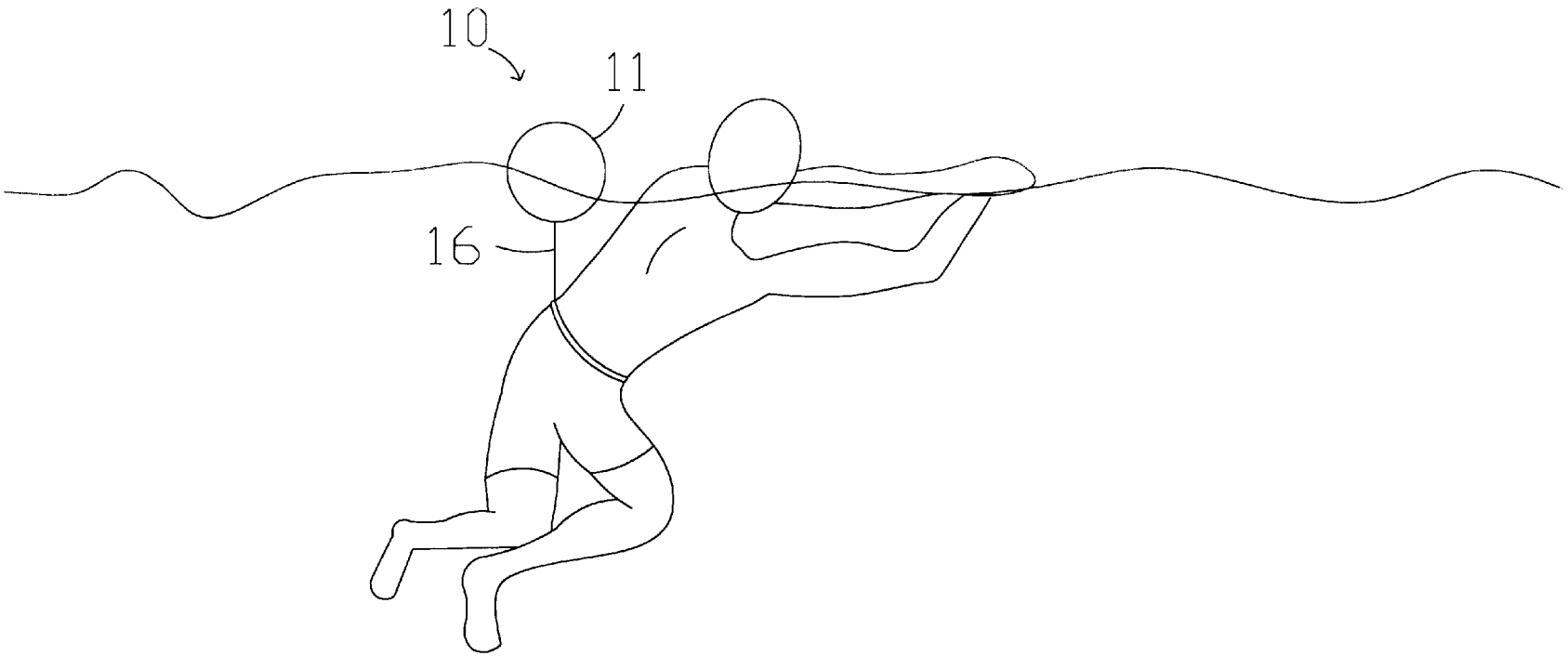
Figure 3C:
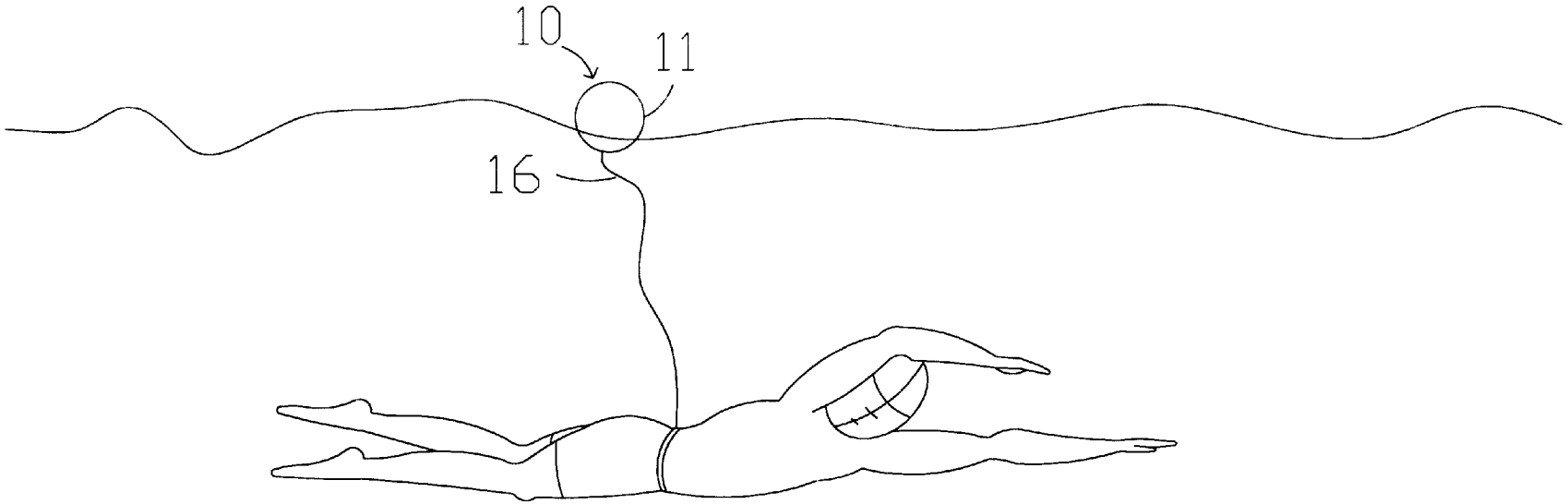

FIGS. 3(*a*) through 3(*c*) are pictorial representations of the action of the buoy of FIGS. 1 and 2 as the child enters the water.

Figure 4A:
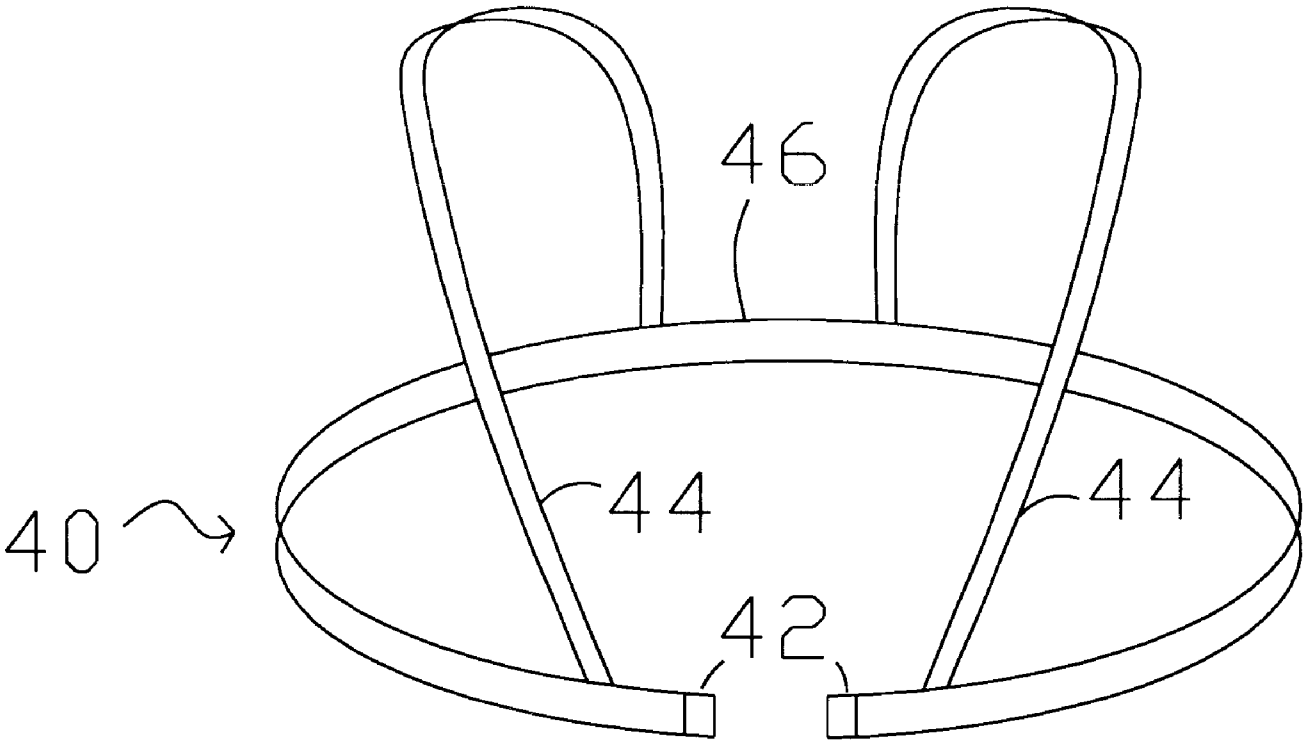
Figure 4B:
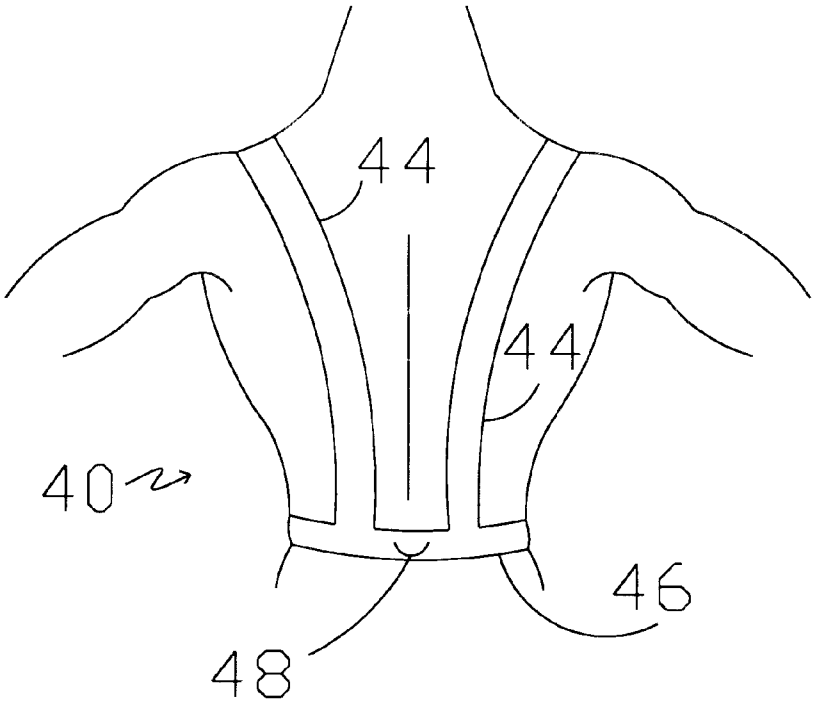

FIGS. 4(*a*) and 4(*b*) are a pictorial view of a harness which may be used to attach the buoy to the body of the child.

Figure 5A:
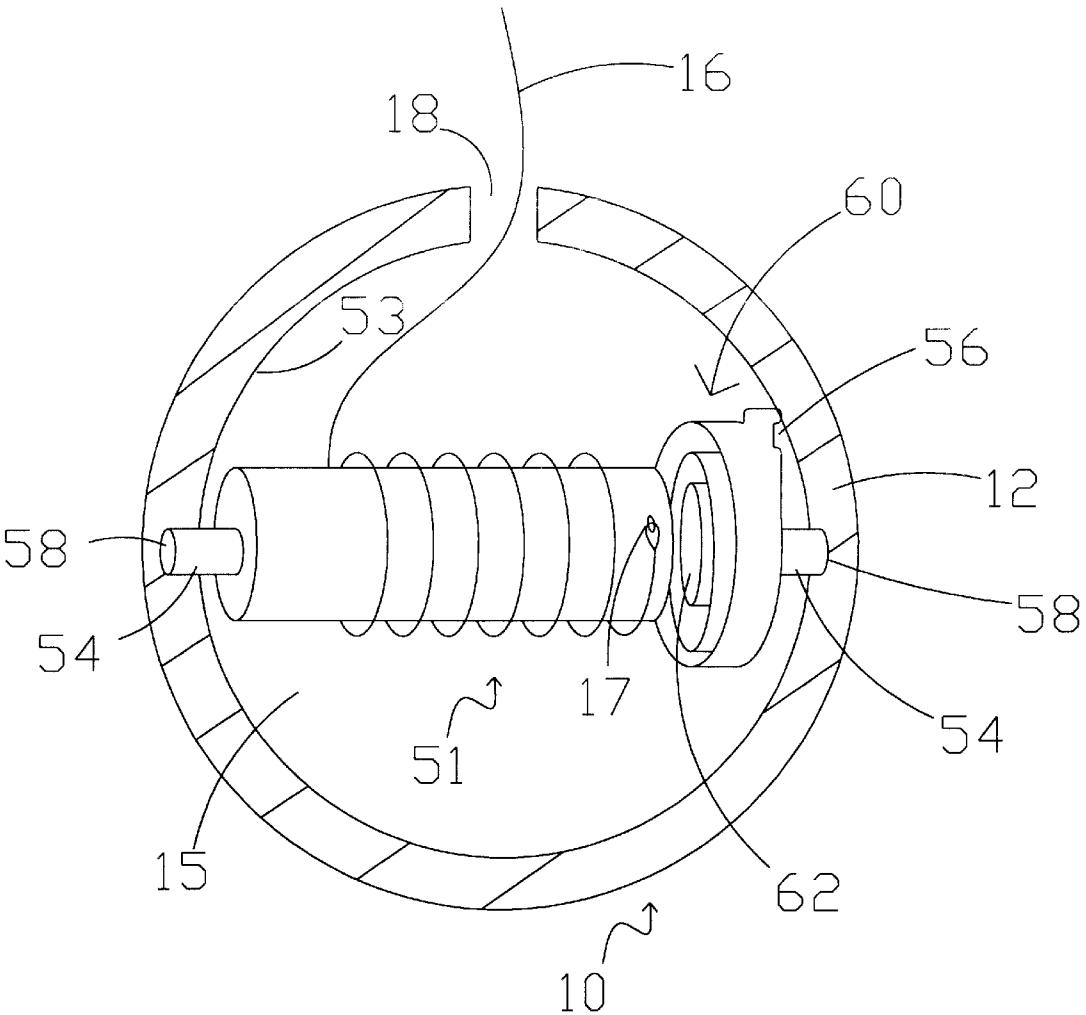
Figure 5B:
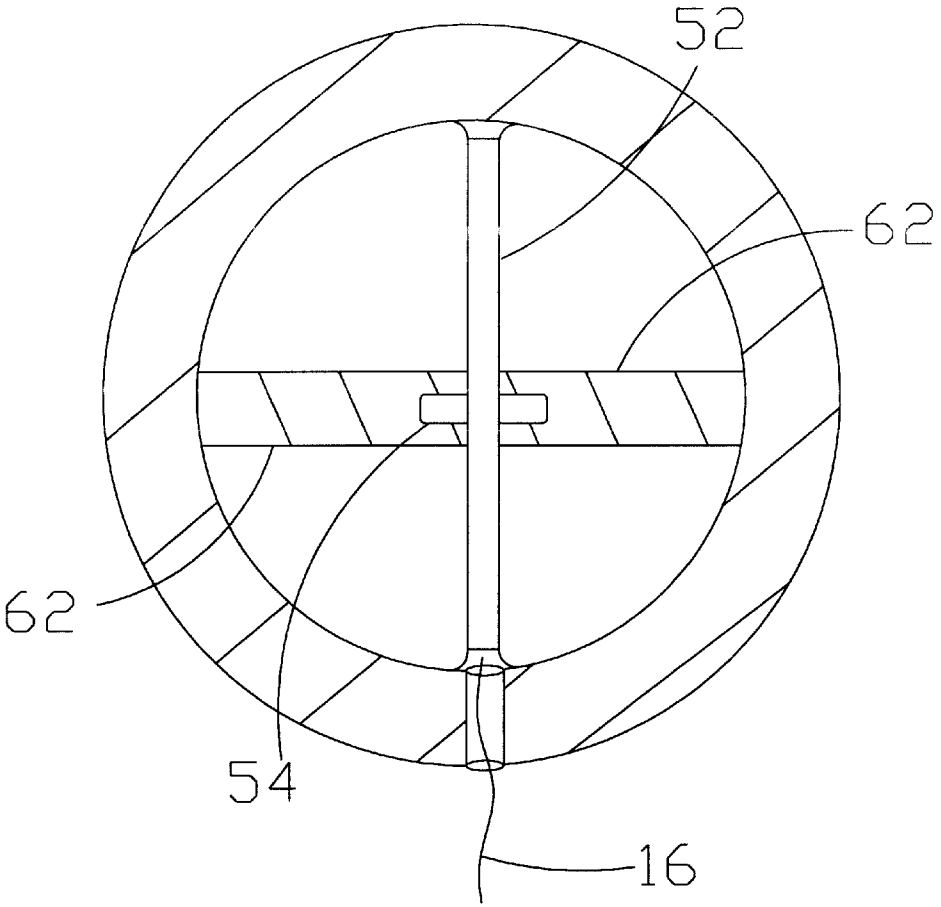

FIGS. 5(*a*) and 5(*b*) are schematic representations of two embodiments of the automatic retractor disposed within the buoy.

THE DETAILED DESCRIPTION OF PREFERRED EMBODIMENTS

An exemplary embodiment of the child locator buoy 10 of the present invention is shown in FIGS. 1 and 2 where the outer shell 11 of floatation material may be any suitable conventional lightweight and waterproof material such as a closed-cell foam. The outer shell may be generally spherical, or shaped like a football, or contoured to rest in the small of a child's back. The shell 11 is desirably from about six to about twelve inches in the largest dimension and may be covered with an outer plastic skin or shell 12 if desired. A color which provides contrast with the water, e.g., blaze orange, is preferred for the shell and/or skin to increase the visibility of the buoy.

As shown in FIG. 1, the float 10 is provided with a central cavity 15 in which may be secured an automatic retractor 14 for a tether 16. The tether 16 exits the float 11 through a suitable passageway 18 which may be lined with any suitable conventional material to reduce the wear of the floatation material 11 or the tether 16 as the tether 16 is repeatedly extended and retracted in use.

The tether 16 may be made of any suitable conventional flexible cord-like material resistant to exposure to the water and sunlight, preferably lightweight but strong enough to resist breakage under the forces associated with its use. For example, a one hundred pound test monofilament fishing line has been found acceptable.

The tether 16 may be of any selected length appropriate for the depth of the water in which the child will be playing. A length of about 10–15 feet has been found acceptable, for example, for a child playing on the beach and in the surf where the mean water level will be two to four feet deep.

The external terminus or distal end of the tether 16 may be attached to any conventional fastener 20 suitable for attachment to the child's clothing, belt or a torso harness 40 such as shown in FIG. 4, i.e. a belt 46 with shoulder straps 44 secured by a conventional clasp, buckle, or clip 42 and a loop 48 for attachment to the tether 16.

The fastener 20 may be kept from entering the float 11 by any suitable means, e.g. by a mechanical stop or the size of the fastener 20 itself. The fastener 20 may optionally be provided with a locking mechanism to prevent inadvertent disconnection or otherwise resist a child's attempt to disconnect it.

With reference to FIG. 5(*a*) where an example of the retractor 14 of FIG. 1 is illustrated, the automatic retractor 51 may comprise a spool 52 attached to the inner wall 53 of the shell 11 and rotationally biased by a torsional spring 60 to wind up the entire length of the tether 16 thereon. The ends 54 of the spool 52 may be mounted in any conventional way within the cavity 15 of the shell 12, e.g. directly in a reduced friction bearing 58 in the internal surface thereof. The spool 52 could be of a large diameter type, as depicted in FIG. 5(*b*), mounted within the cavity 15 by means of an axial connecting rod 62. The internal terminus 17 of the tether 16 is permanently attached to the spool 52. The bias provided by the retractor 14 should be sufficient to retain the float 11 snug against the trunk of the child against the force of gravity so that the float 11 does not dangle when the child is out of the water.

The density of the flotation material and the volume thereof in the shell should be such that the float 11 remains on the surface of the water against the bias of the retractor 14. The bias of the retractor 14 must be sufficient to retain the buoy 10 in the retracted position in air but insufficient to prevent the floatation thereof should the fastener 20 become submerged.

In operation, the fastener 20 forms a releasable connection to the child. As shown in FIG. 3(*a*), the buoy 10 attached near the small of the child's back is kept in the out-of-the-way retracted position while the child is wading in the surf and thus does not materially interfere with the child's play. The distinctive color of the float 11 will, to some extent, aid in locating the child among others in a crowd.

As shown in FIG. 3(*b*), the submergence of the child a slight distance while swimming may cause the float 11 to extend slightly as the buoyant force overcomes the biasing force of the retractor 14. Because no substantial buoyant force is applied to the child, the buoy 10 does not materially interfere with normal swimming or play.

Should the child be knocked off his feet by a wave, or otherwise be submerged and in distress, the location of the child will be revealed by the float 11 as it remains on the surface of the water against the bias of the retractor 14. If the period of submergence of the child is brief, the float 11 will retract as the child surfaces permitting normal play to continue.

The buoy of the present invention is intended as a locator for the child, and not as flotation. It remains in an out-of-the-way position unless and until the child is submerged, and automatically resumes that position when the child resurfaces in normal play. Thus the buoy is substantially non-interfering in normal play, while performing a critical locating function in the unfortunate circumstance that the child experiences distress.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A child locator buoy for assisting the location of a child in water comprising:

a float defining an internal cavity and a passageway to the outer surface thereof, said float having a generally oblate shape contoured to rest in the small of a child's back and being between about six and twelve inches in the largest dimension, the outer surface of said float having a color which sharply contrasts with water;

a spring biased retractor disposed in said internal cavity;

a flexible tether carried by said retractor and extending through said passageway to the outer surface of said float, said tether being resistant to sunlight and water and terminating at the distal end with a fastener adapted for removable attachment to an article of clothing worn by the child such that said float is positioned adjacent to the small of the child's back when the tether is fully retracted, the weight of said float being insufficient to overcome the bias of said retractor in air so that said float is retaintained adjacent the small of the child's back so as not to interfere with the play of the child when out of the water, the bouyancy of said float being insufficient to significantly buoy the child so as not to interfere with the normal play of the child in water but sufficient to maintain said float on the surface of the water against the bias of said retractor when the back of the child is submerged so that said float remains on the surface of the water, the visibility of the float thereby aiding in the location of the child when the child is out of the water, swimming or at play on the surface of the water, or under the water.

2. The buoy of claim 1, including a liner for at least the portion of said passageway intersecting the outer surface of said float to thereby resist the eroding of said passageway as said tether is withdrawn and retracted by said retractor.

3. The buoy of claim 1, wherein said retractor comprises a spool with a flange diameter of more than 75% of the width of said internal cavity.

4. The buoy of claim 1, wherein said retractor comprises a spool with a flange diameter of more than 90% of the width of said internal cavity.

5. The buoy of claim 1, wherein said tether is elastic.

6. The buoy of claim 1, wherein said tether is between about four and about twelve feet in length when fully extended.

* * * * *